United States Patent [19]

Hallgren

[11] 4,440,459

[45] Apr. 3, 1984

[54] ROTATABLE SHELF HARDWARE

[75] Inventor: Charles G. Hallgren, Rockford, Ill.

[73] Assignee: Keystone Consolidated Industries, Inc., Peoria, Ill.

[21] Appl. No.: 376,183

[22] Filed: May 7, 1982

[51] Int. Cl.[3] ..... A47B 49/00; A47B 57/00

[52] U.S. Cl. ..... 312/238; 312/305; 108/94

[58] Field of Search ..... 108/94, 95, 103, 105, 108/139, 142, 141; 312/238, 252, 305, 138, 125, 135, 202, 11; 49/42, 46, 390; 16/82, 10, DIG. 17

[56] References Cited

U.S. PATENT DOCUMENTS

| | | | |
|---|---|---|---|
| 121,155 | 11/1871 | Case | 312/305 |
| 791,798 | 6/1905 | Kling | 108/94 |
| 2,488,641 | 11/1949 | Seawright | 312/135 |
| 2,629,643 | 2/1953 | Davidson | 312/238 |
| 2,698,776 | 1/1955 | Stoeckl | 312/238 |
| 2,777,585 | 1/1957 | Jorgensen | 108/94 |
| 3,160,453 | 12/1964 | Tassell | 312/238 |
| 3,266,857 | 8/1966 | Anderson | 312/305 |
| 3,868,156 | 2/1975 | Vander Ley | 312/238 |
| 3,982,800 | 9/1976 | Gorton et al. | 312/238 |
| 4,181,037 | 1/1980 | Boon et al. | 312/238 |

*Primary Examiner*—Francis K. Zugel
*Assistant Examiner*—Thomas A. Rendos
*Attorney, Agent, or Firm*—Allegretti, Newitt, Witcoff & McAndrews, Ltd.

[57] ABSTRACT

A rotary shelf storage unit for mounting in a corner cabinet includes an upper pivot mounting and a lower pivot mounting. The lower pivot mounting includes an adjustable hub mounted on a plate attached to the floor of the corner cabinet. A hub receptacle projects downwardly from the bottom shelf and engages the hub for support of the shelf unit. The hub includes rollers which are biased outwardly for engagement with appropriately positioned detents of the hub assembly. By adjusting the position of the hub relative to its mounting plate, it is possible to control the detent position of the rotary shelf unit. Wheels attached to the bottom shelf ride on the mounting plate to support the shelf unit.

6 Claims, 9 Drawing Figures

ROTATABLE SHELF HARDWARE

BACKGROUND OF THE INVENTION

This invention relates to an improved rotary shelf unit for a cabinet and the hardware for mounting such a rotary shelf unit.

Corner cabinets, for example as provided in a kitchen, often contain a rotary shelf which enhances access to the full interior of the corner cabinet. These shelves are mounted to operate as a "lazy susan".

Heretofore various suggestions have been made with respect to the hardware for mounting such corner cabinet shelves. Boon et al, U.S. Pat. No. 4,181,037, discloses an assembly utilizing a center mounting post suspended between opposite end pivot connections. Shelves are mounted on the center post and the entire unit may be pivoted about that post.

Another type of assembly is disclosed by Anderson in U.S. Pat. No. 3,266,857 and U.S. Pat. No. 3,281,197. Anderson teaches that the rotary shelf may be attached to a cabinet door and pivot hardware may be attached at both the top and bottom of the door. This configuration eliminates the need for a center support post. Anderson also teaches the use of an adjustable detent mechanism associated with one of the pivot mounts to control the rest or detent position of the rotary shelf unit.

The aforesaid mechanisms are efficient and with proper experience can be installed with relative ease. On the other hand, the mechanism as described in Boon, U.S. Pat. No. 4,181,037, tends to cut down the interior space of such a cabinet because of the necessity of a mounting shaft or center rod for support of the shelves. The mechanisms taught in the Anderson patents overcome the problem of space conservation, yet result in a further problem of placing significant stresses on the cabinet door.

SUMMARY OF THE INVENTION

In a principal aspect the present invention comprises improved rotary shelf hardware designed especially for use with corner cabinet shelves. Included as part of the hardware is a top pivot mounting bracket which is attached to the cabinet door at the top of the door. A lower or bottom pivot mount assembly is affixed to the bottom shelf of the shelf unit. The bottom pivot mount assembly includes an adjustable hub mounted on a plate attached to the floor of the cabinet cooperative with a hub receptacle projecting downwardly from the bottom shelf. Detent means are provided for the cooperative hub and hub receptacle to assist in maintaining the rotary shelf unit in a desired detent position. Wheels attached to the bottom shelf ride on the plate and support the shelf unit.

Thus, it is an object of the invention to provide improved rotary shelf cabinet hardware.

It is a further object of the present invention to provide easily installed, easily adjustable hardware for a rotary shelf unit.

One further object of the present invention is to provide rotary shelf hardware wherein the adjustable detent mechanism for the hardware is positioned below the bottom shelf of the unit.

Another object of the present invention is to provide rotary shelf hardware wherein the detent position for the hardware is adjustable.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

General Description

Figure 1:
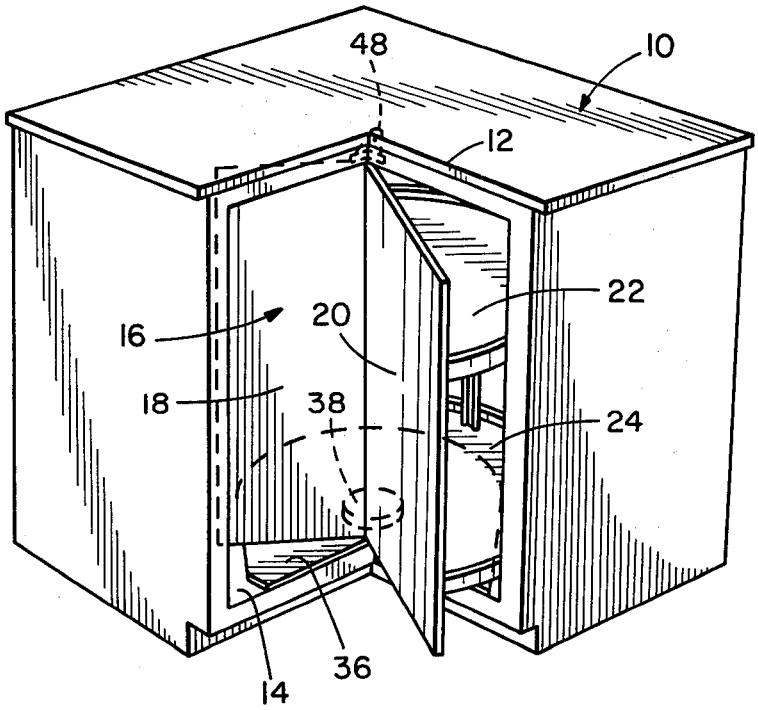
FIG. 1 is a perspective view of the rotary shelf unit of the invention in a corner kitchen cabinet.
Figure 2:
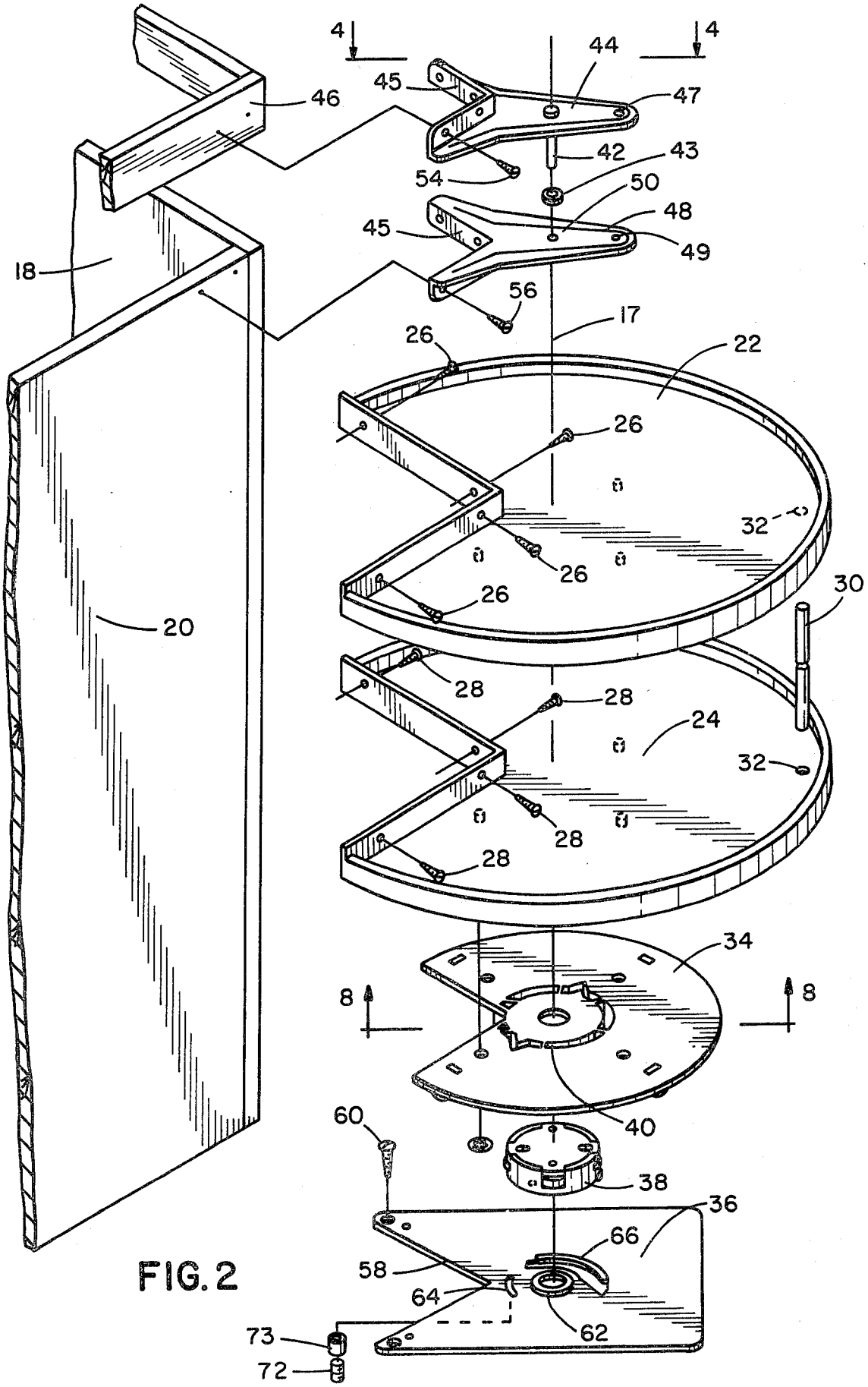
FIG. 2 is an exploded perspective view of the improved rotary shelf unit and hardware of the present invention.

FIGS. 1 and 2 illustrate the general construction and assembly of the improved rotary shelf unit and associated hardware. As shown in FIG. 1, a corner cabinet 10 such as may be installed at floor level or attached to a wall in a kitchen includes a top 12 and a bottom level or floor 14. A rotary shelf unit generally shown at 16 includes first and second front panels or doors 18 and 20 which are joined together to form a 90° angle and thereby define a corner for the cabinet 10. Rotary shelves 22 and 24 are supported by the doors 18 and 20 on the interior of the cabinet 10. The rotary shelf unit 16 is pivotal about a vertical axis 17 in order to permit rotation of the shelves 22, 24 and access to the interior of the cabinet 10.

FIG. 2 illustrates in greater detail the construction of the rotary shelf unit of the present invention. Referring to FIG. 2 and the remaining FIGS. 3 through 8, the doors 18 and 20 are joined together at right angles and shelves 22 and 24 are affixed thereto by means of fasteners 26 and 28 respectively. An optional shelf support bracket 30 is preferably positioned in appropriate slots 32 molded in the separate shelves 22 and 24 at their outer periphery to enhance the separation and support of the shelves 22 and 24. The shelves 22 and 24 are substantially identical to each other and are preferably fabricated by a molding operation from plastic or the like although any suitable material may be utilized for the shelves 22 and 24.

The bottom shelf 24 attached to a hub receptacle mounting flange 34 has a center hub receptacle 40 and radially spaced wheels 96 which support the bottom shelf 24 as well as the total shelf unit 16 in a manner to be described in greater detail below. A lower mounting plate 36 is affixed to the floor 14 of the cabinet 10. An adjustable hub 38 is attached to the plate 36 and is received by the hub receptacle 40 attached to flange 34. In this manner the bottom shelf 24 is directly and firmly aligned on center pivot axis 17 at the center of hub 38 and is supported by wheels 96.

The pivot axis 17 extends vertically through a pivot pin 42. Pivot pin 42 is attached to bracket 44 which is, in turn, attached to the cabinet 10 and more particularly to the corner 46 of cabinet 10. A door support bracket 48 is attached to the two doors 18 and 20 and projects outwardly from the corner intersection of those doors so that a pivot pin opening 50 may receive the pivot pin 42. A Nylon bushing 43 is fitted on pin 42 between braCkets 44 and 48 to maintain spacing of brackets 44, 48.

The rotary shelf unit 16 may thus pivot about the axis 17 through the pin 42 and the center of hub 38. Note that there is no center post for mounting of the shelves 22 and 24. This improves the usable space on each shelf 22 and 24. Also, more than one additional shelf 22 may be included in unit 16 by attachment to the doors 18 and 20. However, in the embodiment disclosed, only middle shelf 22 is provided. Thus, shelf 22 has a lower side slot 32 and shelf 24 has an upper side slot 32 for receipt of bracket 30.

The Upper Pivot Bracket

Figure 4:
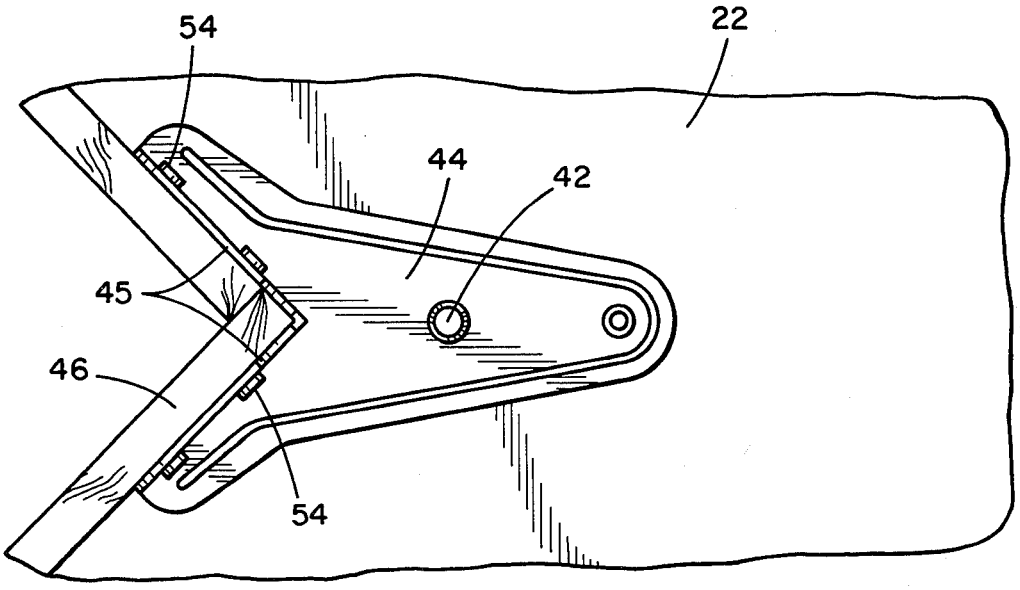
FIG. 4 is a top plan view of the upper pivot bracket of the rotary shelf unit of the present invention taken substantially along the line 4—4 in FIG. 2.
Figure 3:
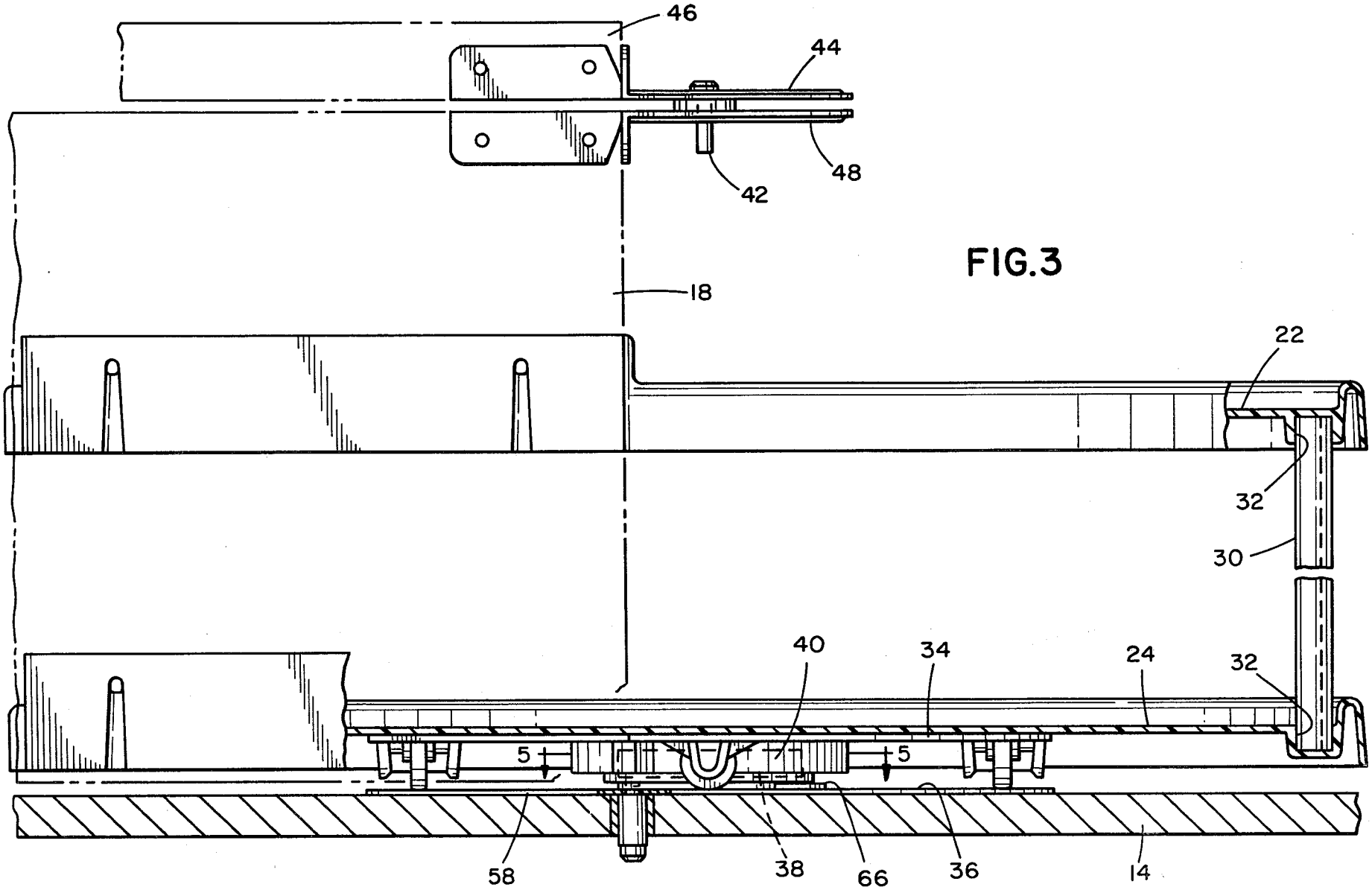
FIG. 3 is a partial side cross sectional view of the rotary shelf unit of the present invention.
Figure 5:
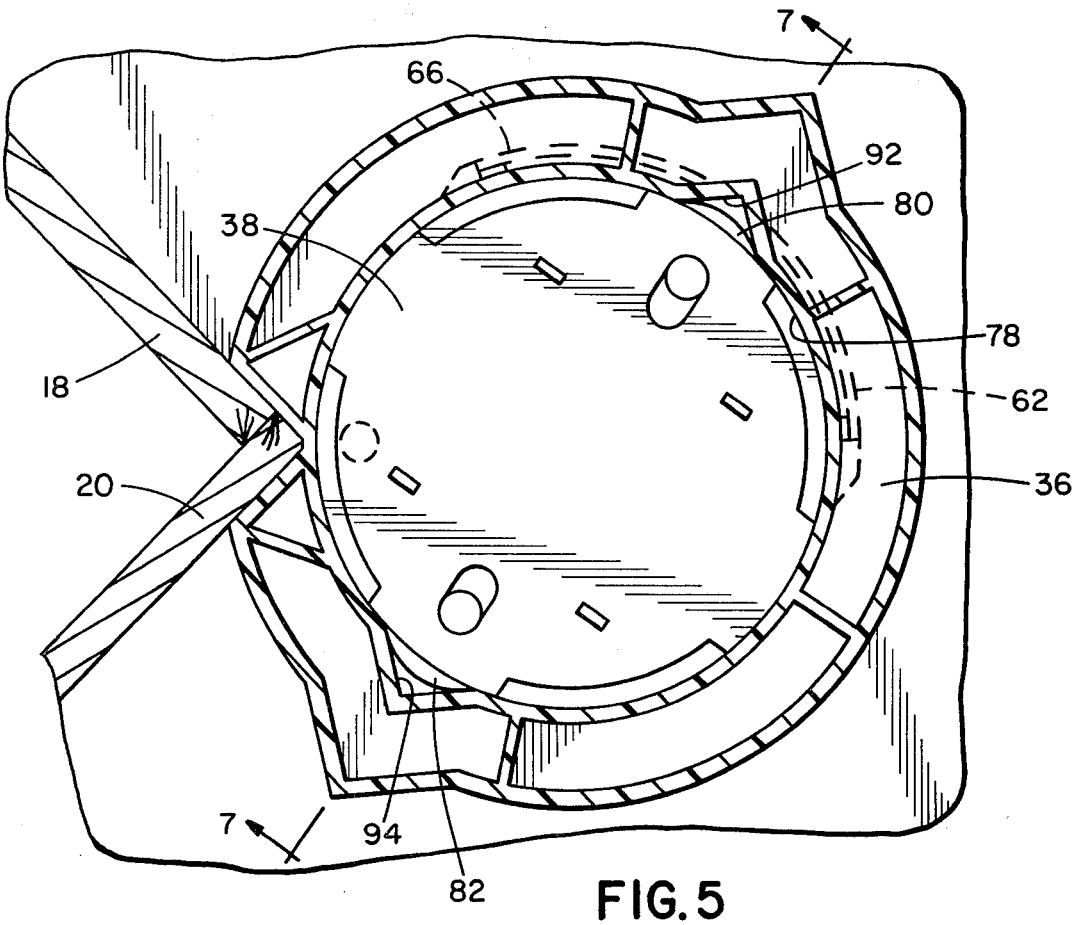
FIG. 5 is a cross sectional view of the lower hub assembly of the rotary shelf unit of the present invention taken substantially along the line 5—5 in FIG. 3.

FIGS. 2, 3 and 4 illustrate in great detail the upper bracket assembly comprised of a cabinet bracket 44 and a door bracket 48. Cabinet bracket 44 as previously described includes the downwardly depending vertical pin 42 aligned with axis 17. Bracket 44 includes a flange 45 which is shaped to fit around a corner 46 and is attached by means of fasteners 54 to the corner 46 of the cabinet 10. Bracket 48 is likewise formed for attachment to the cabinet doors 18 and 20 by means of fasteners 56.

The cooperative bracket 48 is identical to bracket 44. Thus, brackets 44 and 48 may be identically stamped metal components. The brackets 44 and 48, if fabricated in the suggested manner, are positioned in mirror image fashion so that the flanges 45 will not interfere. The pin 42 extends from the bracket 44 for cooperation with the opening 50 in the bracket 48. Bushing 43 is positioned on pin 42. In the embodiment depicted, each bracket 44, 48 includes a separate opening 47, 49 respectively which defines a separate pivot axis for large diameter shelves. Thus a pin (not shown) fastened in opening 47 would cooperate with opening 49 and pin 42 would be removed to effect a top mounting for large diameter shelves. Smaller diameter shelves are pivoted about the axis 17 associated with pin 42 and opening 50. Note that the openings 49, 50 define a line which substantially bisects the obtuse angle defined by flange 45. This insures proper centering and rotation of the shelves regardless of diameter.

The Lower Hub Assembly

Figure 6:
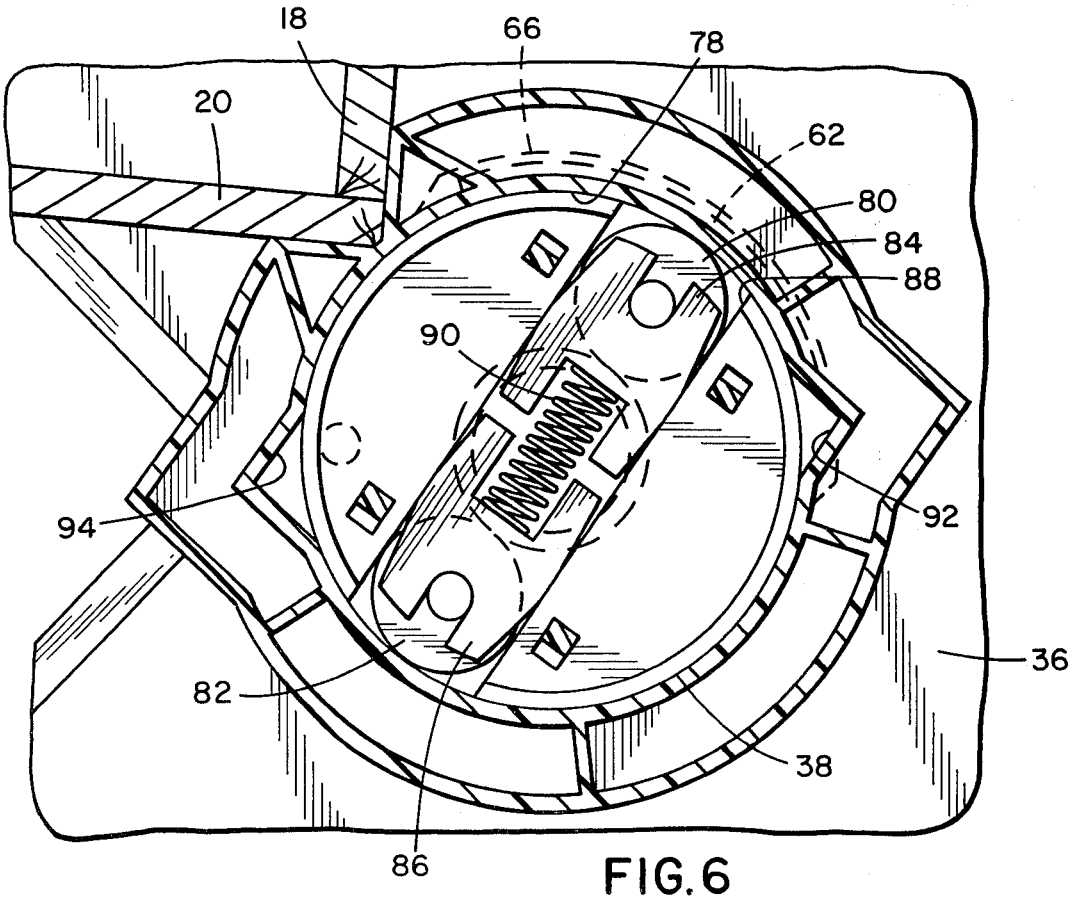
FIG. 6 is a top plan view of the structure of FIG. 5 wherein the cover plate for the hub has been removed.
Figure 7:
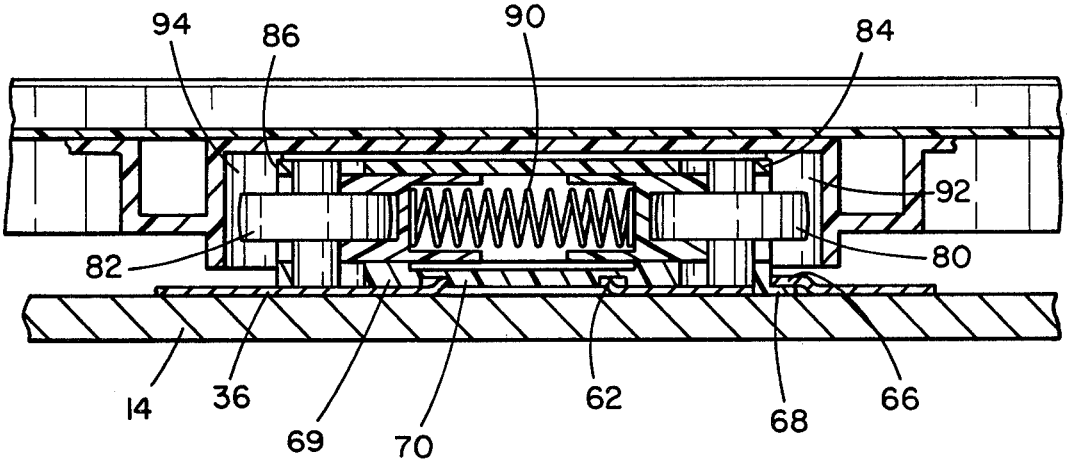
FIG. 7 is a side cross sectional wiew of the hub assembly of FIG. 5 taken substantially along the line 7—7.
Figure 8:
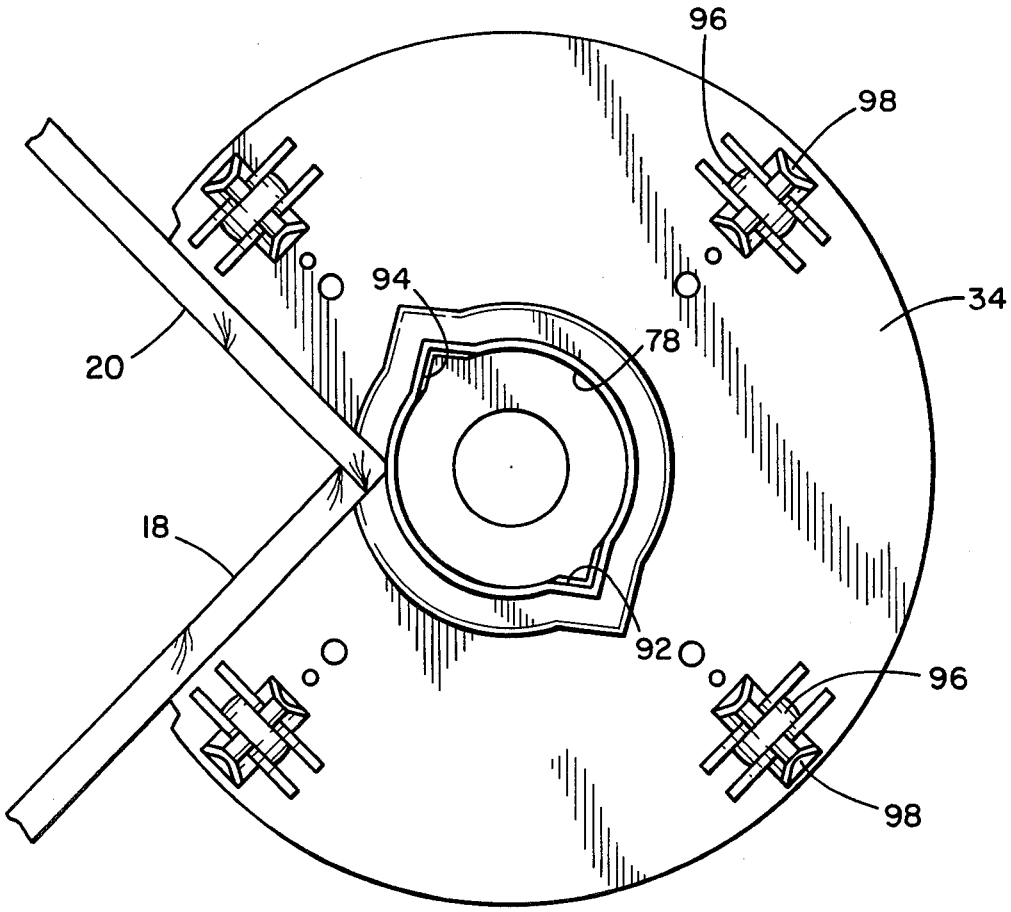
FIG. 8 is a bottom plan view of the hub receptacle and associated flange taken substantially along the line 8—8 in FIG. 2.

FIGS. 2, 3 and 5 through 8 illustrate in greater detail the lower hub assembly. Referring to these figures, the lower mounting plate 36 is generally rectangular as depicted though a circular shape is also acceptable. A V cutout 58 is provided so that the plate may be appropriately positioned in the corner cabinet 10 on the floor 14 without projecting beyond the cabinet 10. Fasteners 60 are used to position the plate 36 on the floor 14 and maintain the plate 36 thereon. The plate 36, which is preferably a metal stamping, includes a raised center opening 62 centered on the vertical axis of rotation 17 of the shelf unit 16. A partial circumferential slot 64 is cut in the plate 36 at a fixed radial distance from the opening 62. A retaining flange 66 is likewise stamped from the plate 36 for cooperation with a projecting lip 68 of the hub 38 as shown in FIG. 7. Lip 68 extends only partially around the circumference of the hub 38 in order to permit rotation of the hub 38 without interference by the lip 68.

As also shown in FIG. 7, the hub 38, which may be fabricated from molded plastic components, includes a molded lower wall 69 with a downwardly projecting circular projection 70. Projection 70 is received by the ring 62 for proper alignment of the hub 38. The hub 38 may be oriented or pivoted on the ring 62 and retained in a desired orientation. Once rotated to the desired orientation, a fastener 72 cooperative with a space 73 projecting through slot 64 is fastened against the hub 38 to retain the hub 38 in a fixed position.

As shown in FIG. 6, the hub 38 includes one set of opposed rollers or wheels or followers mounted therein. The followers 80 and 82 are each mounted in their own carriage 84 and 86 respectively. Each carriage 84, 86 is slidably mounted in opposed relation in a center slot 88 through the hub 38. Center slot 88 lies on a diameter for the hub 38. Interposed between the carriages 84 and 86 is a biasing spring 90 which tends to separate the carriages 84 and 86 and thus force the wheels 80, 82 against the surface 78. Note the wheels 80 and 82 have vertical axes parallel to the center axis 17 of the hub.

The inner surface 78 includes discontinuities or detents 92 and 94 which are spaced 180° apart as are the wheels 80 and 82. The discontinuities or detents 92 or 94 cooperate with the wheels 80 and 82 which act as followers and serve to retain the hub 38 in a detent position relative to the hub receptacle 40.

The hub receptacle 40 is suspended from the flange 34. By appropriately orienting the hub 38, it is possible to control the detent position of the shelf unit 16 and thus align the cabinet doors 18 and 20 properly in the corner when unit 16 is in the closed position.

With shelves of larger diameter, it is necessary to effectively support the center of the hub receptacle to coincide with the pivot axis defined by openings 47, 49 in brackets 44, 48. This is accomplished by means of the special hub 100 and plate 102 depicted in FIG. 9.

Figure 9:
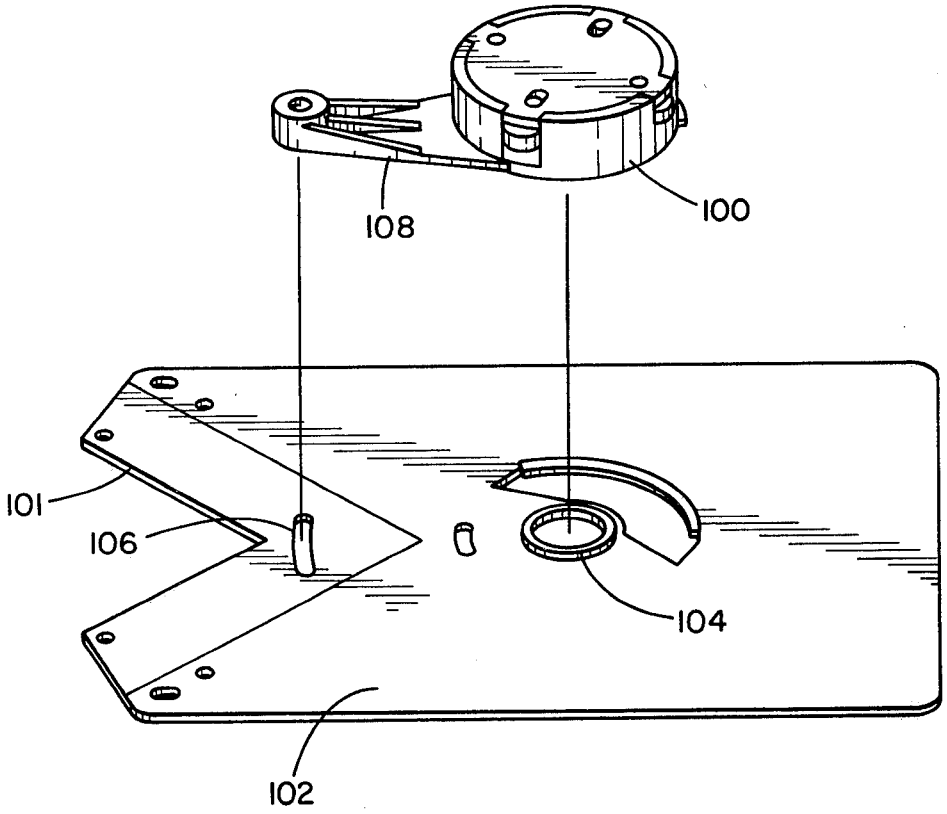
FIG. 9 is a perspective view of a special hub and associated plate used for larger diameter shelving units.

Referring to FIG. 9, plate 102 includes a notch 101 which is not cut as deeply as the notch 58 in plate 36. Thus plate 102 effectively translates its hub retention ring 104 into the cabinet for alignment of the center of ring 104 with the axis defined by openings 47, 49. A slot 106 in plate 102 cooperates with a lever arm 108 projecting from hub 100 to orient the hub 100 on ring 104. The hub 100 is otherwise constructed in the same manner as hub 38.

Also suspended from the flange 34 are a series of four radially spaced rollers or wheels 96 which are attached to the flange 34 so that they will ride on the plate 36. Each roller 96 is mounted on an axle support member 98 depending from flange 34. Each wheel 96 has an axis of rotation about a radius extending from the center of the flange 34 radially outward. The wheels 96 thus roll upon the surface defined by the plate 36. The wheels 96 are appropriately (preferably equally) spaced from the center axis of the flange 34 and from each other so that at any given time at least six of the seven wheels 96 will be in contact with the plate 36 and thereby support the shelf unit 16. Thus wheels 96 are spaced at 45° intervals about the center of flange 34. Importantly the wheels 96 have a diameter slightly greater than the vertical thickness of hub 38 so that wheels 96 support the unit 16 and thus provide for spacing between the hub 38 and receptacle 40. This insures the free pivotal movement of shelf unit 16.

With the present invention, it is possible therefore to easily adjust the detent position of the shelf. It is also clear that the bottom shelf 24, as well as all of the supported and succeeding shelves 22, are rigidly supported not only by the flange 34 and associated wheels 96, but also by attachment to the cabinet doors 18 and 20 and by the support brackets 30. The upper brackets 44 and 48 along with pivot pin 42 serve to maintain the assembly in proper alignment. The majority of the weight of the unit 16 is supported by wheels 96.

It is possible to alter or change the construction as described without avoiding the subject matter and spirit of the invention. Therefore the invention is to be limited only by the following claims and their equivalents.

What is claimed is:

1. Hardware for a rotary shelf unit comprising, in combination:

an upper bracket assembly for pivotally attaching a cabinet door to a cabinet housing to pivot about a vertical axis;

a lower support assembly for attachment to a bottom horizontal shelf affixed to the cabinet door for pivotally supporting the cabinet door about the vertical axis, said lower support assembly including:

a mounting plate for affixing to the floor of a cabinet;

a hub adjustably attached to the mounting plate;

a hub receptacle for attachment to the bottom shelf and for receipt of the hub;

said hub including a laterally outward, biased follower member, and said hub receptacle including at least one detent for cooperation with the follower member;

said biased follower member comprising a coil spring interposed between first and second roller carriages, said carriages mounted for reciprocal movement in a radial slot in the hub, each of said carriages including a roller member rotatable about an axis parallel to the vertical axis; and roller means spacing the bottom shelf and mounting plate.

2. The hardware of claim 1 wherein said hub is pivotally mounted on the mounting plate to pivot about the vertical axis and including means for attaching the hub to the plate at a desired orientation.

3. The hardware of claim 1 including a flange plate for supporting the hub receptacle, said flange plate being attachable to the bottom surface of the bottom shelf.

4. The hardware of claim 3 including a plurality of roller means between the flange plate and mounting plate for supporting the flange plate on the mounting plate.

5. The hardware of claim 1 wherein said roller means comprise a plurality of wheels for suspension from the bottom shelf, said wheels being radially spaced from the pivot axis.

6. The hardware of claim 1 including means for adjusting the position of the pivot axis for the shelves defined by the upper bracket assembly and lower support assembly.

* * * * *